US006209171B1

(12) United States Patent
Pelletier et al.

(10) Patent No.: US 6,209,171 B1
(45) Date of Patent: Apr. 3, 2001

(54) MOVABLE DOOR MOUNTING ASSEMBLY

(75) Inventors: Thomas Pelletier, Wallingford; Gregory Tropea, New Britian, both of CT (US)

(73) Assignee: The Stanley Works

( * ) Notice: Subject to any disclaimer, the term of this patent is extended or adjusted under 35 U.S.C. 154(b) by 0 days.

(21) Appl. No.: 09/410,039

(22) Filed: Oct. 1, 1999

(51) Int. Cl.[7] ..... A47H 15/00

(52) U.S. Cl. ..... 16/97; 16/87 R; 160/196.1; 403/374.5

(58) Field of Search ..... 29/822; 16/87 R, 16/97, 91, 102; 403/374.5; 160/196.1, 199, 201, 206

(56) References Cited

U.S. PATENT DOCUMENTS

| | | | | |
|---|---|---|---|---|
| 3,331,427 | | 7/1967 | Colombo . | |
| 3,479,682 | | 11/1969 | McNinch . | |
| 3,708,178 | * | 1/1973 | Lauricella | 279/81 |
| 3,747,167 | * | 7/1973 | Pravaz | 24/205.17 |
| 3,757,384 | * | 9/1973 | Rusch | 16/97 |
| 3,829,929 | | 8/1974 | Foltz et al. . | |
| 4,256,164 | | 3/1981 | Agcaoili . | |
| 4,359,080 | | 11/1982 | Brydolf . | |
| 4,945,605 | | 8/1990 | Haab et al. . | |
| 5,404,675 | | 4/1995 | Schmidhauser . | |
| 5,461,829 | * | 10/1995 | Lehto et al. | 49/409 |

* cited by examiner

*Primary Examiner*—S. Thomas Hughes
*Assistant Examiner*—John C. Hong
(74) *Attorney, Agent, or Firm*—Pillsbury Winthrop LLP

(57) ABSTRACT

Apparatus for use in mounting a door on an overhead track comprising a carriage assembly constructed and arranged to be moved horizontally along the track in such a way as to limit upward movement thereof, and a door mounted assembly constructed and arranged to be mounted on an upper edge of the door so as to be moved with the door. The door mounted assembly is movable with the door (1) into an initial position wherein a locking member on the carriage assembly is in an initial vertically aligned position with respect to a locking member receiving opening on the door mounted assembly and (2) from the initial position upwardly with a snap action into a locking position wherein the locking member is in a locking position within the opening. A releasing member on the door mounted assembly is operable when the locking member is in locked relation within the opening to be moved from a normal operative position into a releasing position thereof to enable the door mounted assembly to move downwardly with the door into released relation with respect to the carriage assembly.

9 Claims, 8 Drawing Sheets

MOVABLE DOOR MOUNTING ASSEMBLY

This invention relates to door installations and more particularly the movable door mounting assemblies used in door installations.

BACKGROUND OF THE INVENTION

The type of movable door mounting assemblies herein contemplated are the type that mount the door for movement along a horizontally extending track mounted in the door opening. Preferably, the track is along the upper extent of the door opening and the movable door mounting assembly serves to suspend the door from the track.

These assemblies are used with two different types of door installations as, for example, in sliding door installations and folding door installations. For twin or dual sliding door installations, two separate assemblies are provided at opposite sides of the door. In a folding door installation, a single centrally located assembly serves to mount the central portion of an outer door panel which is hinged along one side to an adjacent pivoting door panel. In this case, the door mounting assembly must also support the door for pivotal movement about a central vertical axis as well as for movement along the track.

Prior art assemblies of this type usually embody two cooperating assemblies; namely, an upper carriage assembly which is movable along the track and a lower door mounted assembly which is fixed to the upper portion of the door. The two separate assemblies include cooperating structure enabling the two assemblies to the coupled together and, in most instances, to be decoupled as well.

Efforts have been made to simplify the two assemblies and the structure by which they can be coupled and decoupled. Examples are disclosed in U.S. Pat. Nos. 3,813,728 and 4,945,605. In these simplistic arrangements, coupling is accomplished by simply moving a headed element on one of the assemblies through a horizontally open slot in the other assembly. The problem with these simplistic arrangements is that that can be moved in the opposite direction to the direction of coupling movement to decouple resulting in unwanted decoupling when such opposite direction movement is inadvertently effected.

Where the slot opens laterally, it becomes necessary in order to effect coupling to first lift the door up and to align it with the laterally open slot and then move the door laterally so that the headed member enters the slot. In sliding door installations, the facings applied to the door opening can serve as a stop. While this may be an advantage in preventing unwanted lateral decoupling movement in sliding door installation, it is a disadvantage if the facings must be installed after the door is installed because a lateral movement is required in order to effect the door installation. Even worse, if it should become necessary to remove the door after installation, the facings must be first taken down to remove the door and, of course, replaced after the door has been reinstalled. The above-described advantage from the standpoint of preventing inadvertent decoupling and disadvantages from the standpoint of facing installation inconvenience may not be present in a folding door installation, but it is important from an inventory point of view that movable door mounting assemblies of type herein contemplated be capable of operating effectively in either type of installation.

Whether or not the installation is sliding or folding has a great deal to do with the facings which are applied to the door opening within which the door moves. The facings in the folding installation cannot come down below the upper edge of the door because the door must turn within the opening. On the other hand, with a sliding door the facings can come below the upper edge of the door and it is desirable to do so. In the case of a sliding door, these facings effectively prevent the upper portion of the door from moving laterally to any appreciable extent.

It has also been proposed to provide assemblies of the simplistic type with manually actuated locking mechanisms. Examples of assemblies of this type are disclosed in U.S. Pat. Nos. 3,479,682 and 3,829,929. These installations still require lateral movement of the door to effect installation and, hence, after mounting facings.

As indicated above, it is highly desirable to be able to install and remove the door without regard to the installation of the facings for the door opening. It is also desirable to simplify the movements of the door required for installation and for release when the door is to be removed.

Applicants have found that these desirable characteristics can best be obtained by providing cooperating assemblies that can be coupled by moving the door upwardly from a vertically aligned position below the track and that release can be simplified if the only movement required of the door is down.

BRIEF DESCRIPTION OF THE PRESENT INVENTION

An object of the present invention is the provision of a movable door mounting assembly which obviates the problems noted above while obtaining the desirable characteristics noted above. In accordance with the principles of the present invention, this objective is accomplished by providing an apparatus for use in mounting a door on an overhead track which comprises a carriage assembly constructed and arranged to be moved horizontally along the track in such a way as to limit upward movement thereof. A door mounted assembly is mounted on an upper portion of the door so as to be moved with the door. A first of the assemblies includes a vertically extending locking member and a second of the assemblies has a locking member receiving opening therein. Movable locking structure is provided with respect to the second of the assemblies to be moved between a locking position and a releasing position. A spring is provided to resiliently bias the movable locking structure into the locking position. The door mounted assembly is movable with the door (1) into an initial position wherein the locking member is in an initial vertically aligned position with respect to the locking member receiving opening and (2) from the initial position upwardly into a locking position wherein the locking member is in a locking position within the opening. The locking member and the movable locking structure have interengaging cam surfaces configured and positioned (1) to enable the movement of the door mounting assembly from the initial position thereof to the locking position thereof to move the movable locking structure from the locking position thereof toward the releasing position thereof against the bias of the spring and (2) to allow the movable locking structure to return to the locking position thereof when the locking position of the locking member is reached. The locking member and the movable locking structure include upwardly and downwardly facing interengaging locking surfaces configured and positioned when the locking member and the movable locking structure are in the locking positions thereof to lock the locking member in locked relation within the opening. A manually actuated releasing member is carried by the second of the assemblies for manual movement from a normal operative position into a releasing position. The releasing member is constructed and arranged with respect to the movable locking structure when the locking member is in locked relation within the opening to effect movement of the movable locking structure from the locking position thereof into the releasing position thereof in response to the manual movement of the releasing member from the normal operative position into the releasing position thereof to enable the door mounted assembly to move downwardly with the door into released relation with respect to the carriage assembly.

DETAILED DESCRIPTION OF THE PREFERRED EMBODIMENT

Figure 1:
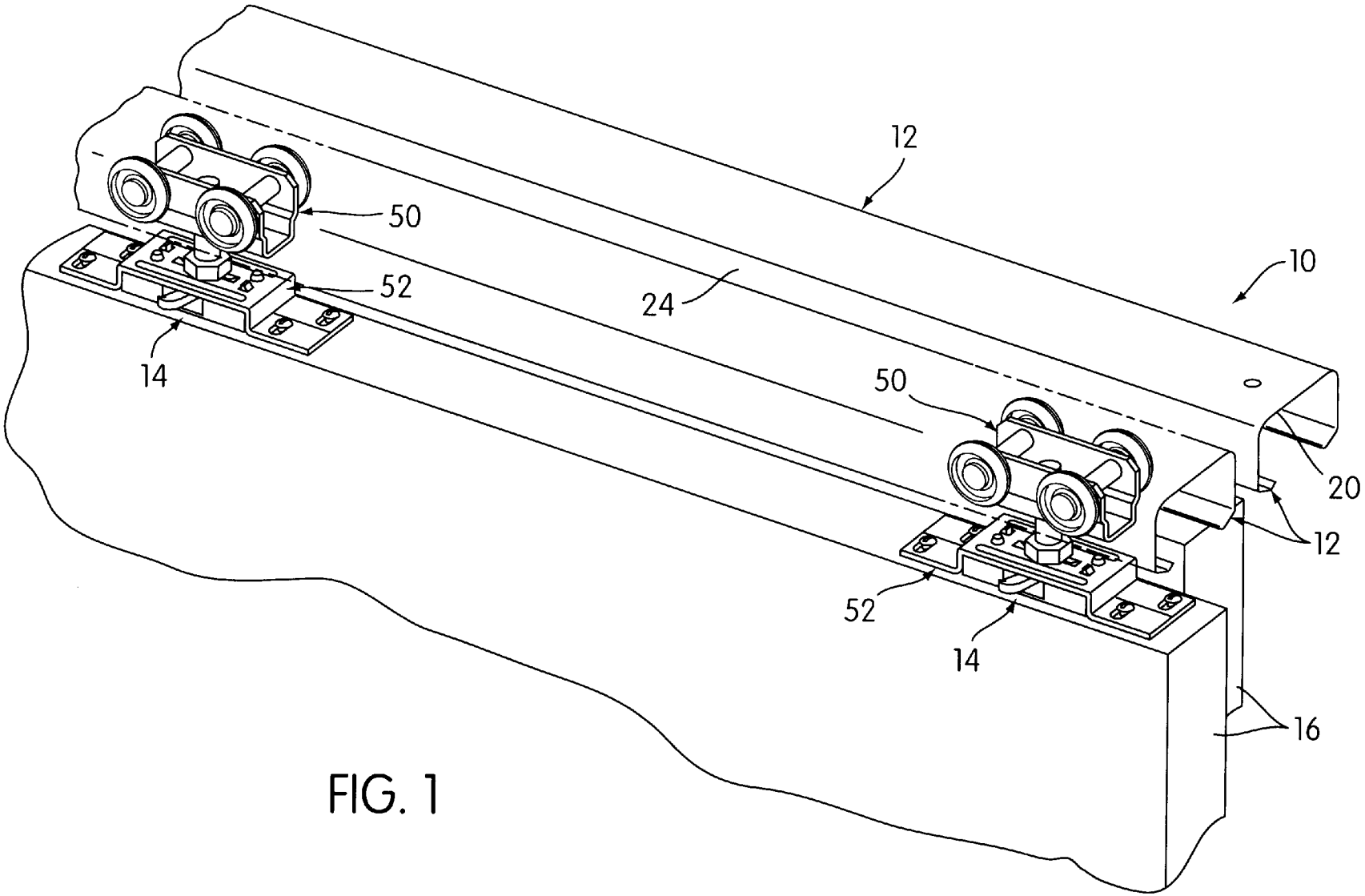
FIG. 1 is a fragmentary perspective view looking down from the top on one side of a twin sliding door assembly embodying the principles of the present invention.

Referring now more particularly to the drawings, there is shown in FIG. 1 thereof a twin sliding door installation, generally indicated at 10, embodying the principles of the present invention. The installation 10 includes a pair of tracks, generally indicated at 12, constructed and arranged to be fixedly mounted in parallel relation to the overhead structure (not shown) defining the door opening of the installation 10. Mounted within each of the tracks 12 is a pair of movable door mounting assemblies, generally indicated at 14. Each pair of assemblies 14 serves to mount a door panel 16 for movement along the associated track 12 between the sides of the structure (not shown) defining the door opening. Suitable structure (not shown) may be provided along the floor structure defining the door opening to guide the lower edges of the door panels during their sliding movement as is well known in the art.

Figure 2:
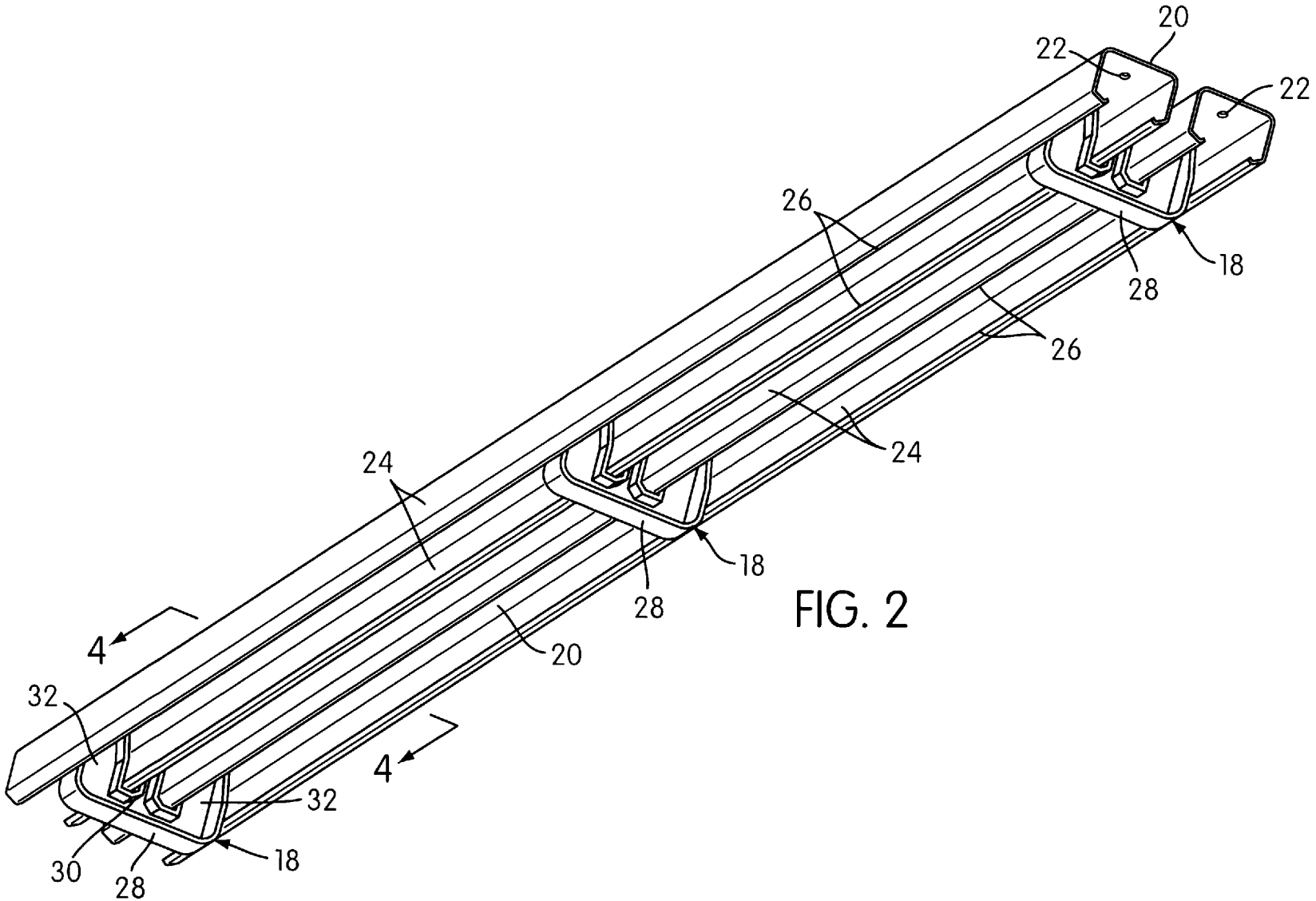
FIG. 2 is a perspective view of the spaced tracks of the installation shown in FIG. 1 with a series of longitudinally spaced removable spacing members removably mounted in an operative position therewith during the installation of the tracks.

FIG. 2 illustrates the combination of the pair of tracks 12 held in a predetermined parallel relation by a series of track spacing members, generally indicated at 18, each of which is constructed and arranged to be removably mounted within and between the pair of tracks 12 so as to retain the same in a predetermined parallel relationship during the installation thereof. Each of the track spacing members 18 is constructed and arranged to enable the track spacing member 18 to be moved into an operative position with respect to the pair of tracks 12, as shown in FIG. 2, in a direction to enter within and between the tracks 12 thereof and to be removed from the operative position with respect to the tracks 12 by movement in the opposite direction, as shown in FIG. 3.

Figure 3:
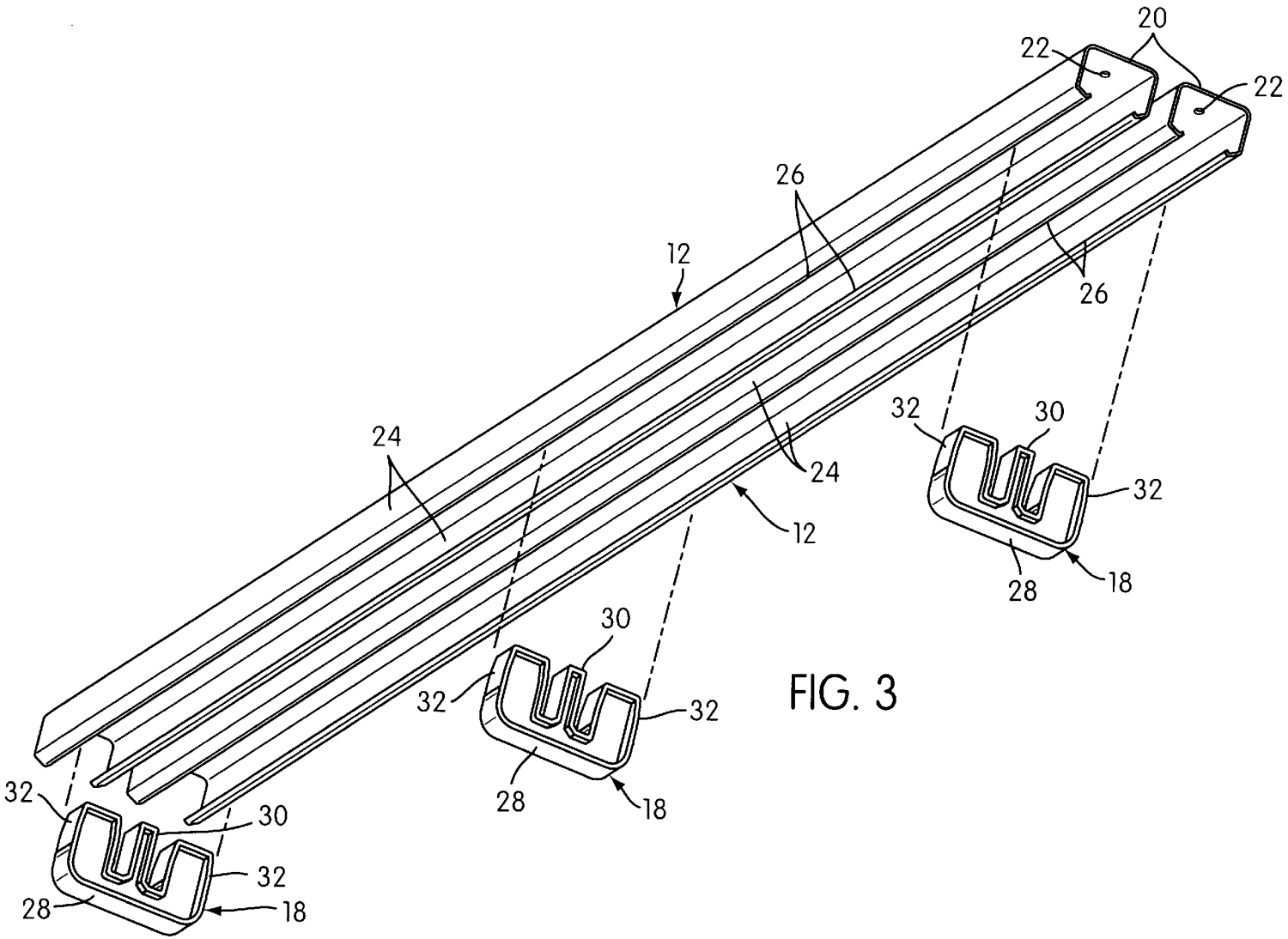
FIG. 3 is a view similar to FIG. 2 showing the spacing members removed from the tracks after they have been installed.
Figure 4:
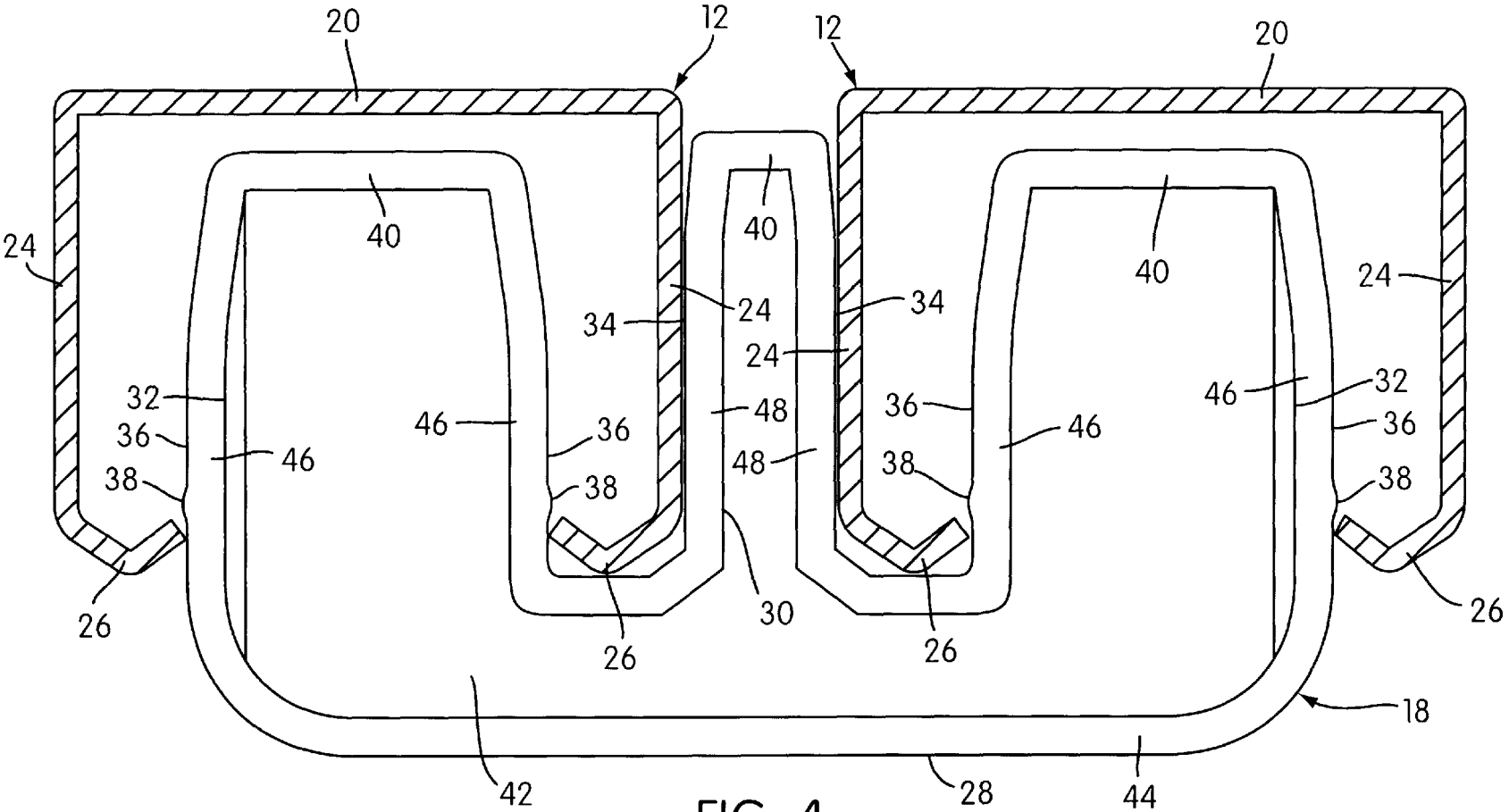
FIG. 4 is an enlarged sectional view taken along the line 4—4 of FIG. 2.

As best shown in FIGS. 2–4, each track 12 includes an elongated central wall 20 which is constructed and arranged to be fixedly mounted beneath the overhead structure defining the door opening. The central wall 20 of each track 12 can be fixedly mounted beneath the overhead structure by any suitable means as, for example, a series of longitudinally spaced screws 22 or the like.

Each track 12 also includes a pair of elongated end walls 24 constructed and arranged when installed to extend downwardly from opposite edges of the central wall 20. Each track 12 also includes a pair of wheel engaging walls or flanges 26 constructed and arranged when installed to extend inwardly toward one another from the lower edges of the end walls 24.

While the track spacing members 18 may be of any suitable construction, the preferred construction shown in the drawings is in the form of a molded plastic body made from a suitable plastic material as, for example, polypropylene. Each of the track spacing members 18 defined by the molded plastic body includes an outer transversely extending transversely extending portion 28, a central track end wall engaging portion 30 extending from the outer portion 28 and track entering portions 32 extending from the outer portion 28 in spaced relation on opposite sides of the central track end wall engaging portion 30. Each central end wall engaging portion 30 includes opposed surfaces 34 configured and positioned to enter between the tracks 12 and engage adjacent end walls 24 of the tracks 12 when the track spacing member 18 is in the operative position thereof. Each track entering portion 32 includes surfaces 36 configured and positioned to engage the inner edges of the wheel supporting walls 26 of the associated track 12 when the track spacing member 18 is in the operative position thereof.

Each surface 36 of each track entering portions 32 includes a slight projection or bump 38 over which the inner edges of the walls 26 snap during the movement of the track spacing member 18 into the operative position thereof and which releasably retain the track spacing member 18 in the operative position thereof. The track entering portions 32 and central portion 30 each include a free end section 40 which tapers inwardly toward a free end thereof to facilitate entry within and between the tracks 12.

In the preferred embodiment shown, the molded plastic body is formed of peripheral walls of generally uniform thickness integrally interconnected by a central reinforcing wall 42. The peripheral walls include an outer peripheral wall 44 defining the outer transversely extending portion 28, a pair of generally U-shaped walls 46 defining the track entering portions 32, each having one end connected to an end of the outer wall 44 and a central U-shaped wall 48 defining the central portion 30 having opposite ends connected to ends of the pair of U-shaped walls 46.

As is indicated in FIGS. 2 and 3, each of the track spacing members 18 is mounted in fixed relation with respect to the two tracks 12 by moving each track spacing member 18 in a direction toward the central wall 20 of the track 12 at a desired position therealong. As each track spacing member 18 is moved inwardly within the two tracks 12, the projections 38 within the surfaces move past the track flanges and the resulting snap action tells the installer than the spacing member has been moved into its operative position. The engagement of the projections 38 beyond the flanges 26 serve to retain the spacing member 18 in its operative relation with respect to the tracks 12.

The number of spacing members 18 included in the series will depend upon the length of the tracks 12. On occasion, there may be a requirement to mount more than two tracks 12 in parallel relation and, in these instances, a series of spacing members 18 can be mounted with respect to each pair of adjacent tracks 12 to effect the predetermined parallel spaced relationship. Once the spacing members 18 have been mounted within the tracks 12, the tracks 12 are moved upwardly into engagement with the overhead structure of the door opening and the tracks 12 are fixed in position as by inserting screws 22 or the like through the central wall and into the overhead structure. Once the tracks have been secured into fixed relation with the overhead structure, the series of spacing members can be removed simply by grabbing the outer wall and pulling down so that each is moved away from the central wall and out of the tracks 12.

The above described installation constitutes a preferred example of movable door installations in which the movable door mounting assembly of the present invention can be used. Others include one track installations such as pocket doors and folded doors, as previously indicated. The movable door assembly 14 embodying the principles of the present invention is best illustrated in FIGS. 5–9.

Referring now more particularly to FIGS. 5–9, the movable door mounting assembly 14 includes generally two assemblies; first, a carriage assembly, generally indicated at 50, which is constructed and arranged to be moved horizontally along the track 12 in such a way as to limit the upward movement thereof and, second, a door mounted assembly, generally indicated at 52, which is constructed and arranged to be mounted on an upper edge of the door so as to be moved with the door. The carriage assembly 50 includes a vertically extending locking member 54 and the door mounted assembly 52 includes a locking member receiving opening 56 therein. The door mounted assembly 52 includes movable locking structure, generally indicated at 58, in the form of a pair of pivoted locking pawls. The movable locking structure 58 is constructed and arranged with respect to a mounting structure, generally indicated at 60, embodied in the door mounted assembly 52 so as to be moved between a locking position and a releasing position. A spring 62 in the form of a split ring serves to resiliently bias the movable locking structure into the locking position.

Figure 6:
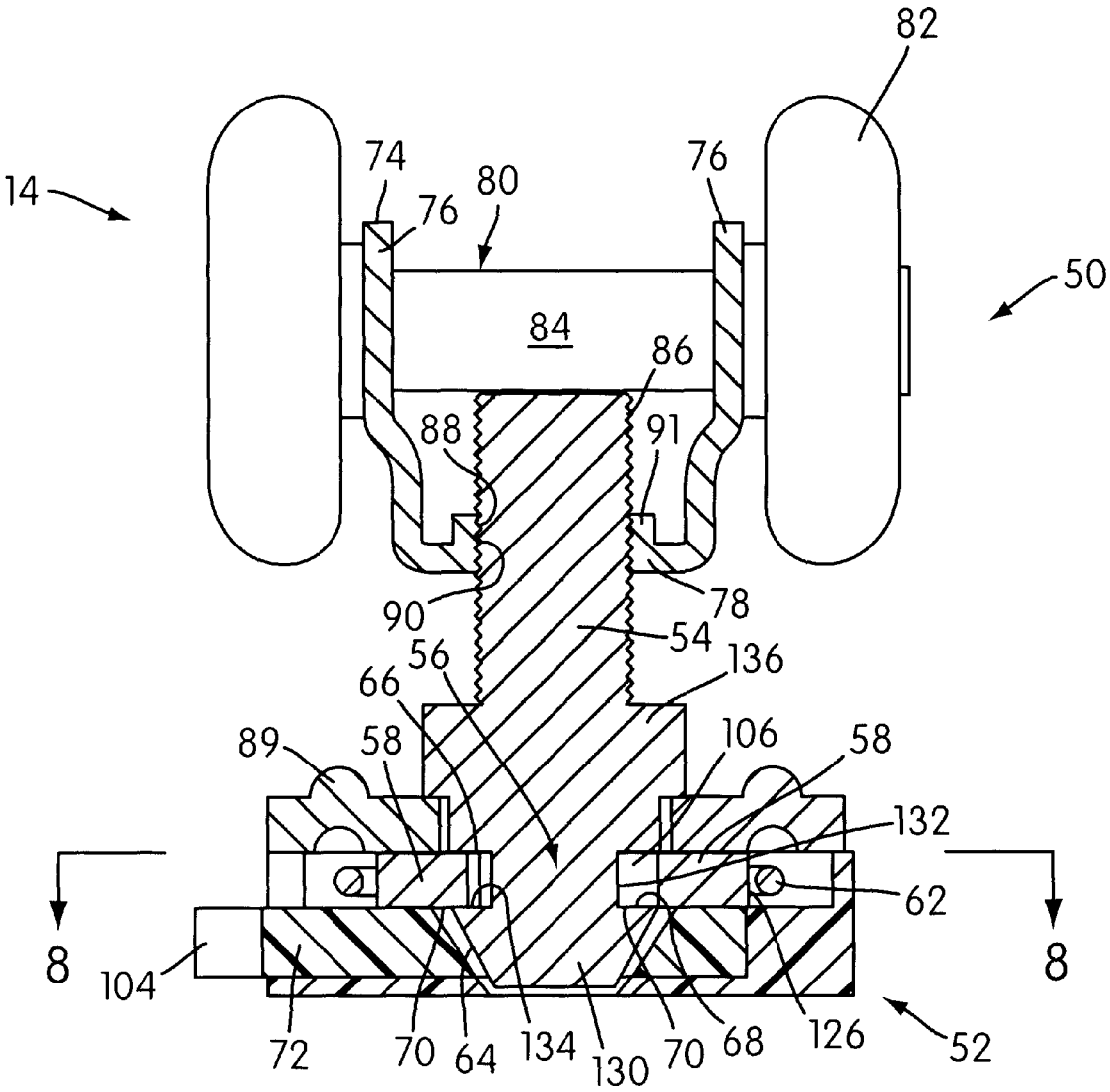
FIG. 6 is a vertical sectional view of the door mounting assembly shown in FIG. 5, illustrating the components in an operative installed position.

Preferably, the door mounted assembly 52 is movable with the door (1) into an initial position wherein the locking member 54 is in an initial vertically lined position with respect to the locking member receiving opening 56 and (2) from the initial position upwardly into a locked position, as shown in FIG. 6, wherein the locking member 54 is in a locked position within the opening 56.

The locking member 54 and the movable locking structure 58 have interengaging cam surfaces 64 and 66 configured and positioned (1) to enable the movement of the door mounting assembly 52 from the initial position thereof to a locking position thereof to move the movable locking structure 58 from the locking position thereof toward the releasing position thereof against the bias of the spring 62 and (2) to allow the movable locking structure 58 to return to the locking position thereof when the locking position of the locking member 54 is reached.

The locking member 54 and the movable locking structure 58 include upwardly and downwardly facing interengaging locking surfaces 68 and 70 configured and positioned when the locking member 54 and the movable locking structure 58 are in the locking positions thereof to lock the locking member 54 in locked relation within the opening 56.

Figure 8:
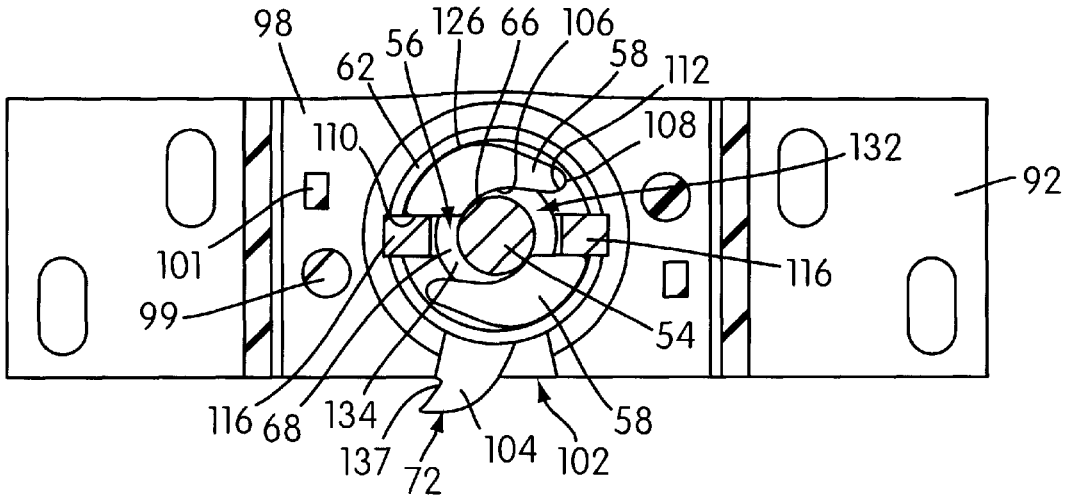
FIG. 8 is a fragmentary sectional view taken along the line 8—8 of FIG. 6.
Figure 9:
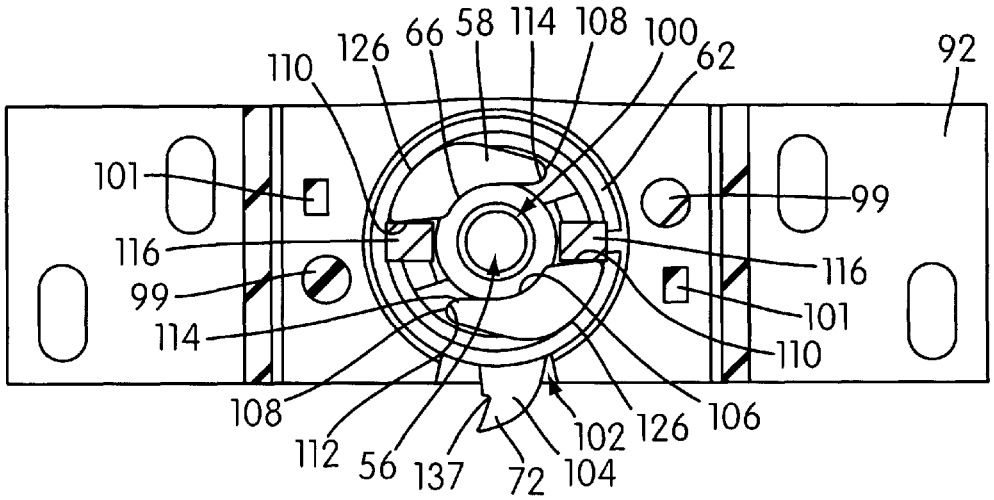
FIG. 9 is a view similar to FIG. 8 showing the manual movable releasing member in the releasing position thereof.

A manually actuated releasing member 72 is mounted on the mounting structure 60 of the door mounted assembly 52 for manual movement from a normal operative position as shown in FIG. 8 to a releasing position as shown in FIG. 9. The releasing member 72 is constructed and arranged with respect to the movable locking structure 58 when the locking member 54 is in locked relation within the opening 56 to effect movement of the movable locking structure 58 from the locking position thereof into the releasing position thereof in response to the manual movement of the releasing member 72 from the normal operative position into the releasing position thereof to enable the door mounted assembly 52 to move downwardly with the door 16 into released relation with respect to the carriage assembly 50.

Figure 5:
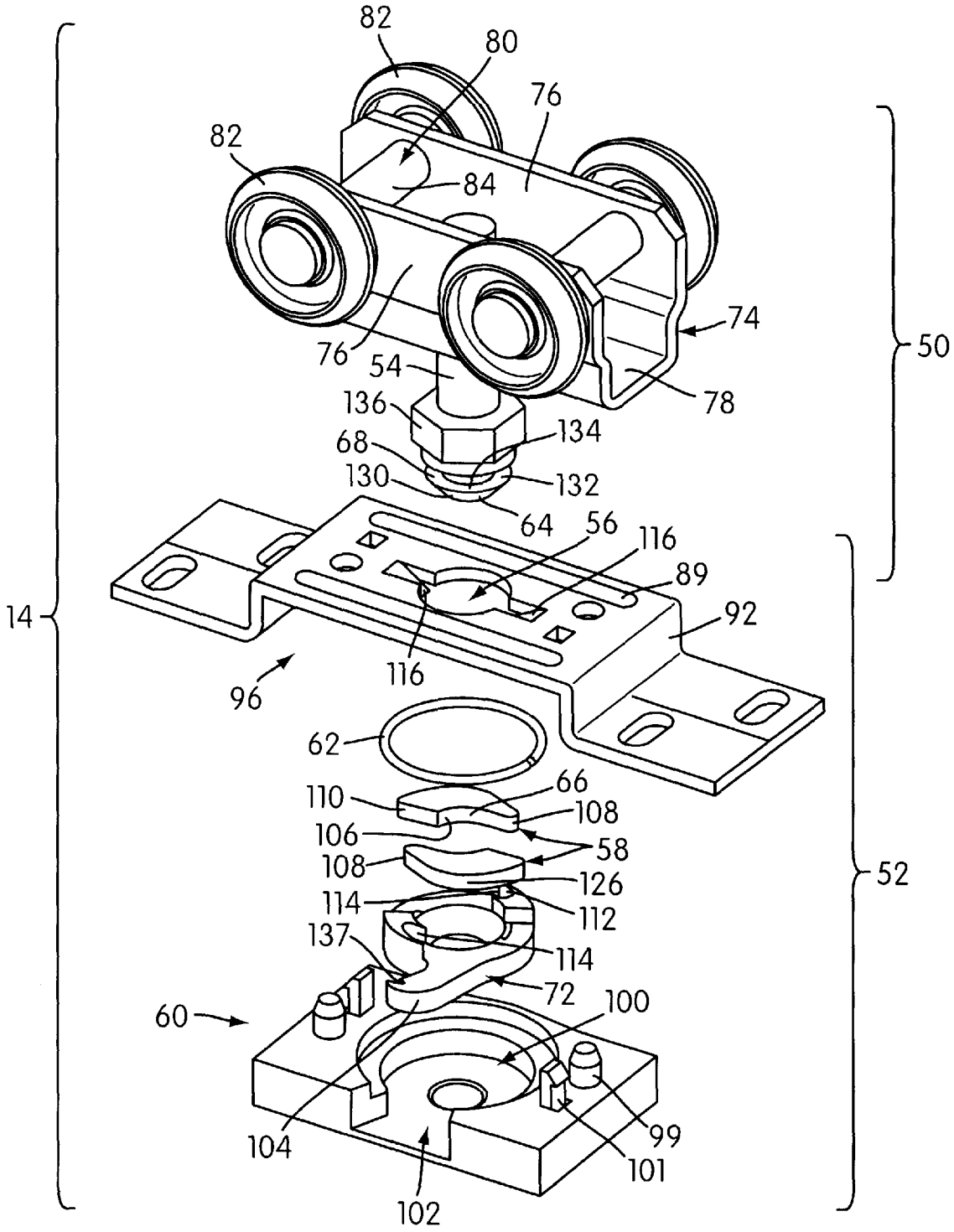
FIG. 5 is an exploded view of one of the door mounting assemblies shown in FIG. 1.
Figure 7:
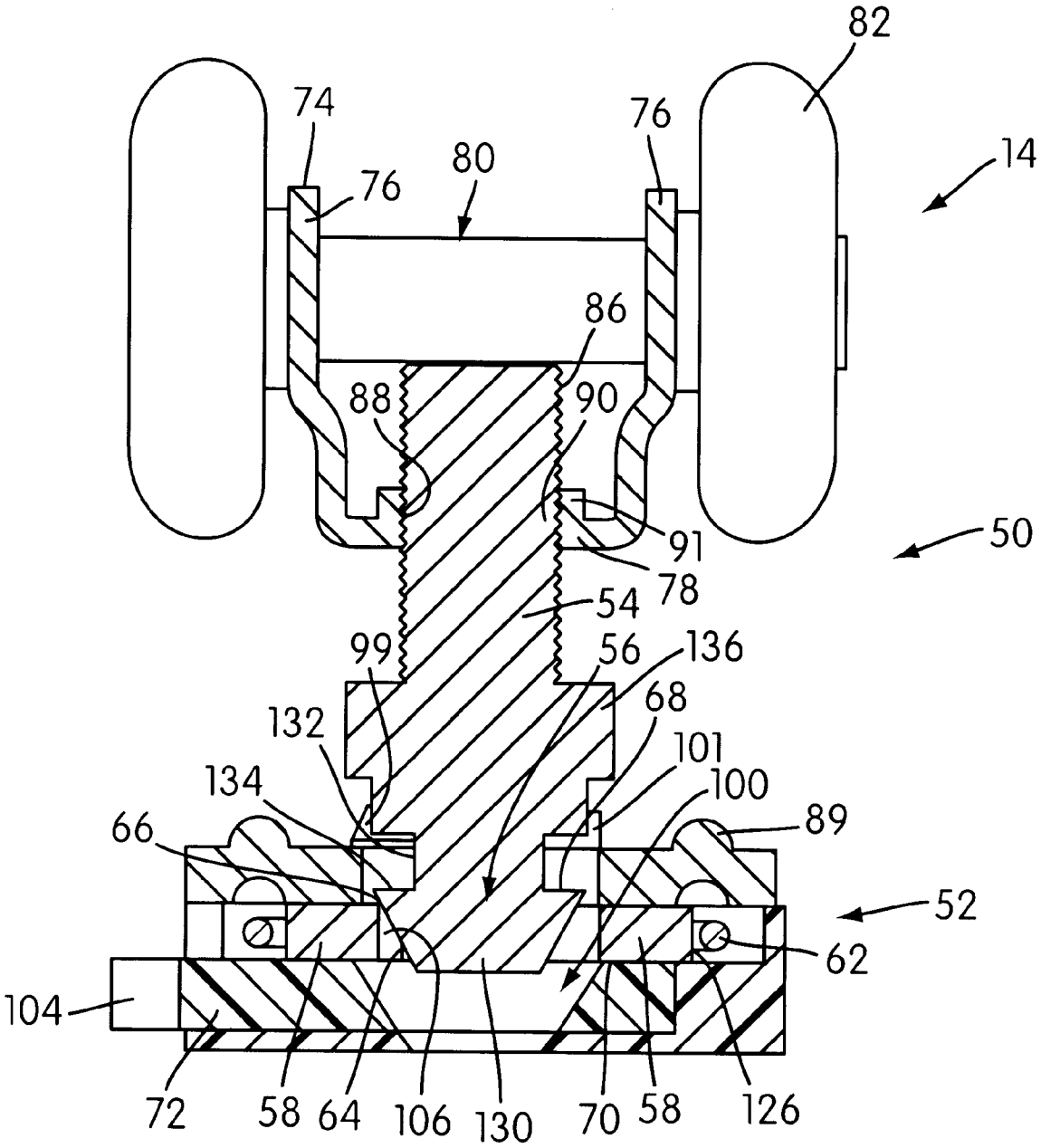
FIG. 7 is a view similar to FIG. 6 showing the components in an initial position preliminary to the movement of the components into the operative installed position shown in FIG. 6.

Referring now more particularly to FIGS. 5–7, each movable door mounting assembly 14 includes generally two assemblies; first, a carriage assembly, generally designated 50, which is constructed and arranged to be moved horizontally along the track 12 in such a way as to limit the upward movement of the assembly 50 with respect to the track 12 and, second, a door mounted assembly, generally designated 52, which is constructed and arranged to be mounted on an upper edge of the door so as to be moved with the door. The carriage assembly 50 includes a vertically extending locking member 54 and the door mounted assembly 52 includes a locking member receiving opening 56 therein.

The door mounted assembly 52 includes movable locking structure, generally designated 58, in the form of a pair of locking pawls. The movable locking structure 58 is constructed and arranged with respect to a mounting structure, generally indicated at 60, embodied in the door mounted assembly 52 so as to be moved between a locking position (see FIG. 8, for example) and a releasing position (see FIG. 9, for example).

A spring 62 in the form of a split ring serves to resiliently bias the movable locking structure 58 into its locking position.

Preferably, the door mounted assembly 52 is movable with the door (1) into an initial position wherein the locking member 54 is in an initial vertically aligned position with respect to the locking member receiving opening 56 and (2) from the initial position upwardly into a locked position, (shown, for example, in FIG. 6) wherein the locking member 54 is in a locked position within the opening 56.

The locking member 54 and the movable locking structure 58 have interengaging cam surfaces 64 and 66 (see FIG. 7, for example) configured and positioned (1) to enable the movement of the door mounted assembly 52 from the initial position thereof to a locking position thereof to move the movable locking structure 58 from the locking position thereof toward the releasing position thereof against the bias of the spring 62 and (2) to allow the movable locking structure 58 to return to the locking position thereof when the locking position of the locking member 54 is reached.

The locking member 54 and the movable locking structure 58 include upwardly and downwardly facing interengaging locking surfaces 68 and 70, respectively, (see FIG. 6, for example) configured and positioned when the locking member 54 and the movable locking structure 58 are in the locking positions thereof to lock the locking member 54 in locking relation within the locking member receiving opening 56.

A manually actuated releasing member 72 is mounted on the mounting structure 60 of the door mounted assembly 52 for manual movement from a normal operative position (FIG. 8) to a releasing position (FIG. 9). The manually actuated releasing member 72 is constructed and arranged with respect to the movable locking structure 58 when the locking member 54 is in locked relation within the opening 56 to effect movement of the movable locking structure 58 from the locking position thereof into the releasing position thereof in response to the manual movement of the manually actuated releasing member 72 from the normal operative position into the releasing position thereof to enable the door mounted assembly 52 to move downwardly with the door into released relation with respect to the carriage assembly 50.

The structure of the carriage assembly 50 can best be appreciated from FIGS. 5 and 6. The carriage assembly 50 includes a bracket 74 having opposing vertically extending, horizontally spaced walls 76 and a central horizontal wall 78 extending therebetween. The carriage assembly 50 further includes pair of wheel assemblies 80 having wheels 82 constructed and arranged to engage the track 12 to provide the horizontal movement of the carriage assembly 50 along the track 12 and to limit the upward movement of the carriage assembly 50 with respect to the track 12 as aforesaid. Each wheel assembly 80 includes a horizontally disposed axle 84 extending through the vertical walls 76 of the bracket 74 and a pair of the wheels 82 mounted on opposite ends of the axle 84.

The locking member 54 is an elongated structure preferably made of steel or other suitable metal having threads 86 at one end thereof and having the cam and locking surfaces 64, 68 at an opposite end thereof, the threaded end being threadedly engaged with threaded structure 88 carried by the bracket 74 (see FIG. 6, for example). The opposite end of the locking member 54 is rotatably mounted in the opening 56 of the door mounted assembly 52 when the locking member 54 is in the locking position in the opening 56 so that the locking member 54 is rotatably engaged with the movable locking structure 58 and can freely rotate in the opening 56. Rotation of the locking member 54 effects threaded vertical movement of the locking member 54 with respect to the bracket 74 to vertically reposition the locking member 54 in the carriage assembly 50 to adjust the vertically spaced relation as aforesaid.

The bracket 74 of the carriage assembly 50 is a metallic structure, preferably made of steel or other metal of appropriate strength by stamping or by other appropriate means. The bracket 74 is reinforced by ribs 89 formed during the stamping process and is provided with a plurality of openings or various sizes and shapes. The horizontal wall 78 of the carriage assembly 50 includes a central opening 90 formed by punching or other appropriate process to include an integral annular upwardly extending lip structure 91 which surrounds the opening 56. The inner wall surface of the lip structure 91 is tapped internally to form the threaded structure 88 on the bracket 74. The threaded engagement between the bracket 74 and the locking member 54 provides an interference fit therebetween to resist vertical repositioning of the locking member 54 with respect to the bracket 74 when a door is supported on the locking member 54.

The structure of the door mounted assembly 52 is best appreciated from the exploded view of FIG. 5. The door mounted assembly 52 includes a mounting bracket 92 that is constructed and arranged to be fixed to the door edge by a plurality of screws 94 (not shown in FIG. 5, but shown in FIG. 1). The mounting bracket 92 has a central recess 96. A central bracket opening 56 in the central recess 96 of the bracket 74 provides the locking member receiving opening 56.

The manually actuated releasing member 72 includes a housing portion 98. The housing portion 98 is mounted within the central bracket recess 96 by a plurality of locating projections 99 and a plurality of snap hooks 101 on the housing portion 98. The housing 98 has a central housing portion recess 100 and a side opening 102. Preferably, the housing portion 98 is an integral structure made of a suitable molded plastic material and the locating projections 99 and the snap hooks 101 are integrally formed thereon.

The manually actuated releasing member 72 is pivotally mounted within the central housing recess 100 for pivotal movement with respect to both the housing portion 98 and the mounting bracket 92 about a vertically extending axis. The manually actuated releasing member 72 has a manual release handle 104 extending outwardly of the mounting structure 60 through the side opening 102 in the housing portion 98. Preferably, the manually actuated releasing member 72 is an integral plastic structure formed by molding or other suitable process to include the housing portion 98 and the handle portion 104 as one integral plastic structure.

The pair of opposing locking pawl members of the movable locking structure 58 are disposed on opposite sides of the locking member receiving opening 56 (see, for example, FIG. 9) and are interengaged with the manually actuated releasing member 72 and with the spring 62 for movement between the locking and releasing positions.

More particularly, each of the locking pawl members is a generally arcuate structure preferably made of steel or other appropriate metal. The structure of the locking pawl members is best appreciated from FIG. 5. Each pawl member has an arcuate inner side wall portion 106 providing an arcuate inner edge portion of the pawl member and has an arcuate end wall portion 108 at one end and an essentially straight wall portion 110 at an opposite end.

The housing portion 98 of the manually actuated releasing member 72 has a pair of recesses 112 providing concave wall structure 114 within each recess 112 constructed and arranged to pivotally receive the arcuate end wall portion 108 of a respective pawl member. The recesses 112 are disposed on generally opposite sides of the vertically extending axis of the housing portion 98 when the manually actuated releasing member 72 is in the recess in the housing. It can be appreciated from FIGS. 8–9 that the recesses 112 are approximately 180 degrees apart.

The mounting bracket 92 provides fixed support structure 116 in the form of two struck tabs formed in the metal of the bracket 92. The support structure 116 is positioned on opposite sides of the vertically extending axis of the assembled door mounted assembly 52 so that the two support structures 116 are fixedly positioned on opposite sides of the opening 56 of the door mounted assembly 52. Each pawl member is mounted in the mounting structure 60 such that the arcuate end wall 108 is biased by the spring 62 into pivotal engagement with a respective recess 112 on the releasing member 72 and the generally opposite straight wall portion 110 of each pawl member is biased by the spring 62 into sliding pivotal engagement with respective fixed support structure 116 on the mounting bracket 92.

The pawl members are disposed when the movable locking structure 58 is in the locking position thereof such that respective inner arcuate edge portions 106 thereof are disposed within the locking member receiving opening 56 on generally opposite sides thereof (as shown, for example, in FIG. 9). The door mounted assembly 52 is constructed and arranged such that (1) when the door mounted assembly 52 moves from the initial position thereof to the locking position thereof, the cam structure 64 on the locking member 54 causes generally radially outward movement of the pawl members against the spring force provided by the spring 62 to allow the locking member 54 to be received within the locking member receiving opening 56 as aforesaid and (2) when the locking member 54 is in the locking position in the locking member receiving opening 56, the locking member 54 can be released from the locking position by pivoting the manually actuated releasing member 72 in a releasing direction about the vertically extending axis, wherein pivotal movement of the manually actuated releasing member 72 in the releasing direction causes generally radially outward pivotal movement of the pawl members against the spring force to thereby move the arcuate inner edge portions thereof out of the lock member receiving opening 56.

As best seen in FIGS. 8 and 9, each pawl member includes a generally arcuate outer edge portion 126 spaced radially outwardly of the inner arcuate edge portion thereof. The spring 62 has a split or open ring configuration and is disposed in generally surrounding relation to pawl members, thereby providing a generally radially directed spring force on each pawl member toward the vertically extending axis to bias the pawl members toward and into their locking positions.

The locking member 54 has a frusto-conical end structure 130 and an annular groove 132 on the opposite end thereof. The frusto-conical structure 130 provides the locking member 54 with a frusto-conical surface which provides the cam surface 64 thereon. The annular groove 132 is constructed and arranged to receive the pawl members in locking engagement with the locking member 54 and provide an upwardly annular surface 134 which provides the upwardly facing locking surface 68 on the locking member 54.

The downwardly facing locking surfaces 70 are provided by respective downwardly facing surfaces on the pawl members (see FIG. 6, for example).

The pawl members include upwardly facing edge surfaces which provide the cam surfaces 66 (see FIG. 7, for example) on the movable locking structure 58.

As will become apparent from the description of the operation of the door mounting assembly 14 considered immediately below, the locking member 54 is pivotally mounted about a vertical axis with respect to the movable locking structure 58 when the locking member 54 is in the locking position thereof within the opening 56. The depending locking member 54 is constructed and arranged to carry the door mounted assembly 52 in vertically spaced relation with respect to the track 12. The locking member 54 is carried by the carriage assembly 50 in vertically adjustable relation to adjust the vertically spaced relation to adjust the vertical distance between the track 12 and the top of the door.

Operation

To mount a single sliding door on a track 12, a door mounted assembly 52 is mounted on each end of the top edge of the door with screws 92 in a manner shown in FIG. 1. A track 12 is mounted in the doorway as aforesaid and a pair of carriage assemblies 50 are mounted in the track 12. The opening 56 on a door mounted assembly 52 is vertically aligned with the downwardly extending locking member 54 on the associated carriage assembly 50 and the door is raised. (To simplify the description of the operation and thereby better explain the operation of the present invention, it is assumed that one door mounted assembly 52 at a time is mounted to the associated carriage assembly 50, but it is possible to mount both door mounted assemblies 52 on the associated carriage assemblies 50 simultaneously.) During upward door movement, the camming edge surface 66 on each pawl member contacts the camming surface 64 on the locking member 54, and further upward movement of the door thereafter causes the pawl members to move apart against the force of the spring. During this outward movement of the pawl members, each pawl member pivots outwardly from the opening 56 about the associated recess 112 in the manually actuated releasing member 72 (while the releasing member 72 is retained in its operative position) which causes the straight edge portion 110 to pivot away from the associated support structure 116, thereby moving the arcuate inner side wall portion 106, and thus the camming surface 66 and the locking surface 70 provided by the pawl member out of the opening 56.

This outward pivotal movement of the pawl members about the respective recesses 112 on the manually actuated releasing member 72 allows the frusto-conical end portion of the locking member 54 to enter the opening 56 and move downwardly relative to the door mounted assembly 52 past the pawl members so that the annular groove 132 is horizontal aligned with the pawl members. The engagement of the wheels 82 with the track 12 limits the vertical movement of the carriage assembly 50 with respect to the track 12 to allow the user to push the door mounted assembly 52 against the locking member 54 of the carriage assembly 50 when installing the door.

When the pawl members are aligned with the groove 132, the spring 62 biases the pawl members into the annular groove 132 and thus into locking the engagement with the locking member 54. The door mounted assembly on the opposite end of the door is mounted on the locking member of the associated carriage assembly in a similar manner. It can be appreciated that the movable door mounting assemblies 14 allow the door installer to easily install a door on a track 12. Because the door mounted assembly 52 moves vertically upwardly into locking engagement with the locking member 54 on the carriage assembly 50, the door installer can align the opening 56 on the door mounted assembly 52 with the locking member 54 while the weight of the door is still resting on the ground (or a temporary support surface placed in the doorway under the track 12 to facilitate installation). After the locking member 54 and opening 56 are aligned, the door can be lifted to hang the door on the track 12. It can also be appreciated that because facings are often installed on the doorway (where a sliding door is mounted) to hide the track(s) 12 from view, the movable door mounting assembly 14 allow the door installer to install a sliding door panel on the track 12 after the facing has been mounted on the doorway. Facings are structures that cover the track 12, the portions of the door mounting assembly 14 hanging down below the track 12 and often a small portion of the top edge of the sliding door(s). It is understood that facings of this type are not used in conjunction with folding door comprised of multiple hinged door panels because the individual door panels of a folding door must be free to pivot out of the plane of the doorway during door opening movement. When a facing is in place for a sliding door, it can be understood that it the movable door mounting assembly 14 allows the door to be mounted on the track 12 (and removed therefrom) without removing the facing. This is advantageous because it allows a builder flexibility in constructing and finishing a doorway for a sliding door and in hanging and removing the sliding door in the doorway.

The user may then adjust the vertical space between the top of the door and the track 12 for each door mounted assembly 52-carriage assembly 50 pair by adjusting the vertical position of the respective locking member with respect to the associated carriage assembly to thereby "plumb" or level the door. To make this vertical adjustment of the locking member, a wrench can be used to rotate a hexagonal nut structure 136 integrally formed on the locking member 54. Rotation of the locking member 54 by the wrench causes the locking member to threadedly move vertically up or down (depending on the rotational direction of the locking member 54 with respect to the bracket 74 of the carriage assembly 50) with respect to the bracket 74 of the carriage assembly 50 to thereby adjust the vertical height of the associated side of the door. The user can adjust one or both door mounted assembly 52/carriage assembly 50 pair as desired.

The user can then open and close the door by sliding the carriage assembly 50 along the track 12.

To release the door from locking engagement with the carriage assembly 50, the user rotates the release member 72 in a counter clockwise direction from the point of view of FIGS. 8 and 9. This causes the concave wall structures 114 on the housing portion 98 of the releasing member 72 to move counter clockwise, carrying the arcuate end wall portions 108 of the associated pawl member with them. The straight wall portion 110 of each pawl member is prevented from moving in a counter clockwise direction by the associated rigid fixed support structure 116 on the bracket 92 so that movement of the releasing member 72 in the releasing direction (i.e., in the counter clockwise direction) causes the straight wall portion of each pawl member (because of the surface-to-surface contact between each pawl member and the associated support structure 116) to slide generally radially outwardly in a direction away from the opening 56 (in surface-to-surface engagement t/ the support structure 116) and to simultaneously pivot about the support structure 116 outwardly out of the opening 56 to allow the inner side wall portion 106 (and the associated locking surface 68) of the pawl member to pivot outwardly from the opening 56 to the position shown in FIG. 9. This pivotal movement moves each pawl member out of the groove 132 on the locking member 54, thereby allowing the locking member 54 to move out a locking engagement with the opening 56.

It can be understood from FIGS. 6–9 that the manually actuated releasing member 72 is rotated in the releasing direction (counterclockwise in FIGS. 8–9) by engaging the manual release handle 104 that extends outwardly from the opening 102 in the housing 98. It can be appreciated that the release handle 104 is constructed and arranged to allow sliding door to be released from the track 12 without removing the facing covering the track and exposed portions of the movable door mounting assembly 14 (if a facing is provided on the doorway). More particularly, the handle 104 is provided with a notch 137 that is constructed and arranged to engage an appropriate tool that can be inserted up behind the facing of the doorway. This arrangement allows the sliding door to be easily removed from and remounted on the track 12 when a facing is provided on the doorway without removing the facing.

After the locking member 54 is released from the opening 56, the user simply releases the releasing member 72 and the same pivots clockwise (from the point of view of FIGS. 8 and 9) back into its holding position (shown in FIG. 8).

It can be understood that when the movable door mounting assembly is used to mount a sliding and folding door in a doorway, the rotatable engagement between the locking member and the door mounted assembly allows the individual door panels of the folding and sliding door to pivot out of the plane defined by the doorway into a folded position in which each panel extends generally perpendicularly to the plane of the doorway.

Any U.S. patents or patent applications mentioned or cited hereinabove are hereby incorporated by reference into the present application.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. Apparatus for use in mounting a door on an overhead track comprising a carriage assembly constructed and arranged to be moved horizontally along the track in such a way as to limit upward movement thereof, a door mounted assembly constructed and arranged to be mounted on an upper edge of the door so as to be moved with the door, a first of said assemblies including a vertically extending locking member and a second of said assemblies having a locking member receiving opening therein, movable locking structure constructed and arranged with respect to the second of said assemblies to be moved between a locking position and a releasing position, a spring constructed and arranged to resiliently bias said movable locking structure into said locking position, said door mounted assembly being movable with the door (1) into an initial position wherein the locking member is in an initial vertically aligned position with respect to said locking member receiving opening and (2) from said initial position upwardly into a locking position wherein said locking member is in a locking position within said opening, said locking member and said movable locking structure having interengaging cam surfaces constructed and arranged (1) to enable the movement of said door mounting assembly from the initial position thereof to the locking position thereof to move said movable locking structure from the locking position thereof toward the releasing position thereof against the bias of said spring and (2) to allow said movable locking structure to return to the locking position thereof when the locking position of the locking member is reached, said locking member and said movable locking structure including upwardly and downwardly facing interengaging locking surfaces constructed and arranged when said locking member and said movable locking structure are in the locking positions thereof to lock said locking member in locking relation within said opening, and a manually actuated releasing member carried by the second of said assemblies for manual movement from a normal inoperative position into a releasing position, said releasing member being constructed and arranged with respect to said movable locking structure when said locking member is in locking relation within said opening to effect movement of said movable locking structure from the locking position thereof into the releasing position thereof in response to the manual movement of said releasing member from the normal inoperative position into the releasing position thereof to enable the door mounted assembly to move downwardly with the door into released relation with respect to said carriage assembly.

2. Apparatus as defined in claim 1 wherein said locking member is pivotally mounted for movement about a vertical axis with respect to said movable locking structure when said locking member is in the locking position thereof within said opening.

3. Apparatus as defined in claim 2 wherein said locking member is constructed and arranged to carry said mounting structure in vertically spaced relation with respect to said track, said locking member being carried by said carriage assembly in vertically adjustable relation to adjust said vertically spaced relation.

4. Apparatus as defined in claim 3, said carriage assembly further comprises a bracket having opposing vertically extending, horizontally spaced walls and a central horizontal wall extending therebetween, a pair of wheel assemblies having wheels constructed and arranged to engage said track to provide said horizontal movement of said carriage assembly along said track and to limit said upward movement of said locking member with respect to said track, each wheel assembly comprising a horizontally disposed axle extending through said vertical walls of said bracket and a pair of said wheels mounted on opposite ends of said axle, said locking member being an elongated structure having threads at one end thereof and having said cam and locking surfaces at an opposite end thereof, said threaded end being threadedly engaged with threaded structure carried by said bracket and said opposite end of said locking member being rotatably mounted in said mounting structure when said locking member is in said locking position in said opening such that rotation of said locking member effects threaded vertical movement of said locking member with respect to said bracket to vertically reposition said locking member in said carriage assembly to adjust said vertically spaced relation as aforesaid.

5. Apparatus as defined in claim 4, wherein said bracket of said carriage assembly is metallic and said horizontal wall thereof includes a central opening, said threaded structure comprising internal metallic threading formed in said opening, said threaded engagement between said bracket and said locking member being constructed and arranged to provide an interference fit therebetween to resist vertical repositioning of said locking member.

6. Apparatus as defined in claim 5, said door mounted assembly thereof comprising a mounting bracket constructed and arranged to be fixed to said door edge by a plurality of screws, said mounting bracket having a central recess and having a central bracket opening providing said locking member receiving opening, a housing mounted within said central bracket recess by a plurality of locating projections and a plurality of snap hooks, said housing having a central housing recess and a side opening, said releasing member being pivotally mounted within said central housing recess for pivotal movement with respect to said housing and said mounting bracket about a vertically extending axis, said the releasing member having a manual release handle extending outwardly through said side opening in said housing, said movable locking structure comprising a pair of opposing locking pawl members, said pawl members being disposed on opposite sides of said locking member receiving opening and being interengaged with said manually actuated releasing member and with said spring for movement between said locking and releasing positions.

7. Apparatus as defined in claim 6, wherein each of said locking pawl members is a generally arcuate structure having an arcuate inner side wall providing an arcuate inner edge portion of the pawl member and having an arcuate end wall portion at one end and an essentially straight wall portion at an opposite end, said releasing member having a pair of recesses providing concave wall structure within each recess constructed and arranged to pivotally receive the arcuate end wall portion of a respective pawl member, said recesses being disposed on generally opposite sides of said vertical axis, said mounting bracket providing fixed support structure on opposite sides of said vertical axis, each pawl member being mounted in said mounting structure such that said arcuate end wall is biased by said spring into pivotal engagement with a respective recess on said releasing member and said essentially straight wall portion is biased by a spring force provided by said spring into sliding pivotal engagement with respective support structure on said mounting bracket, said pawl members being disposed when said movable locking structure is in said locking position such that respective inner arcuate edge portions thereof are disposed within said locking member receiving opening on generally opposite sides thereof, said mounting structure being constructed and arranged such that (1) when said mounting structure moves from said initial position thereof to said locking position thereof, said cam structure on said locking member causes generally radially outward movement of said pawl members against said spring force to allow said locking member to be received within said locking member receiving opening as aforesaid and (2) when said locking member is in said locking position in said locking member receiving opening, said locking member can be released from said locking position by pivoting said releasing member in a releasing direction about said axis, wherein pivotal movement of said releasing member in said releasing direction causes generally radially outward pivotal movement of said pawl members against said spring force to thereby move said arcuate inner edge portions thereof out of said lock member receiving opening.

8. Apparatus as defined in claim 7, wherein each pawl member includes a generally arcuate outer edge portion spaced radially outwardly of said inner arcuate edge portion thereof and wherein said spring has an open ring configuration and is disposed in generally surrounding relation to pawl members, thereby providing a generally radially directed spring force on each pawl member toward said axis.

9. Apparatus as defined in claim 8 wherein said locking member has a frusto-conical structure and an annular groove on said opposite end thereof, said frusto-conical structure providing a frusto-conical surface which provides said cam surface on said locking member and said annular groove being constructed and arranged to receive said pawl members in locking engagement with said locking member and providing an annular surface which provides said upwardly facing locking surface on said locking member, and wherein said downwardly facing locking surfaces are provided by respective downwardly facing surfaces on said pawl members, said pawl members including upwardly facing edges surfaces which provide said cam surfaces on said movable locking structure.

* * * * *